United States Patent [19]

Blackington

[11] 4,064,415

[45] Dec. 20, 1977

[54] INDUCTIVE SPARK IGNITION FOR COMBUSTION ENGINE

[75] Inventor: Paul Albert Blackington, Afton, N.Y.

[73] Assignee: The Bendix Corporation, Southfield, Mich.

[21] Appl. No.: 658,957

[22] Filed: Feb. 18, 1976

[51] Int. Cl.[2] ..... H05B 37/02; H05B 39/04; H05B 41/36

[52] U.S. Cl. ..... 315/209 T; 123/148 E; 315/219; 315/224

[58] Field of Search ..... 315/209, 209 T, 219, 315/224, 225, 226; 123/148 E

[56] References Cited

U.S. PATENT DOCUMENTS

| | | | |
|---|---|---|---|
| 3,219,876 | 11/1965 | Bays et al. | 315/209 T |
| 3,531,737 | 9/1970 | Thakore | 315/209 T |
| 3,666,989 | 5/1972 | Boyer | 315/219 |
| 3,725,732 | 4/1973 | Thakore | 315/209 T |
| 3,795,826 | 3/1974 | Adey | 123/148 E |
| 3,940,658 | 2/1976 | Allred | 315/209 T |
| 3,949,722 | 4/1976 | Linstedt et al. | 315/209 T |
| 3,965,878 | 6/1976 | Salway | 315/209 T |

*Primary Examiner*—Saxfield Chatmon, Jr.
*Attorney, Agent, or Firm*—Raymond J. Eifler; Kenneth A. Seaman; S. H. Hartz

[57] ABSTRACT

An inductive spark ignition system for a gas turbine engine in which the switching semiconductor and other components are protected from failure under igniter plug load conditions. The ignition system includes means for positively turning off the switching semiconductor to start a firing cycle and for insuring that the switching semiconductor remains nonconducting long enough to dissipate the energy in the firing circuit. A Darlington transistor is used for switching and means are provided for limiting voltage and current in the transistor pair.

10 Claims, 1 Drawing Figure

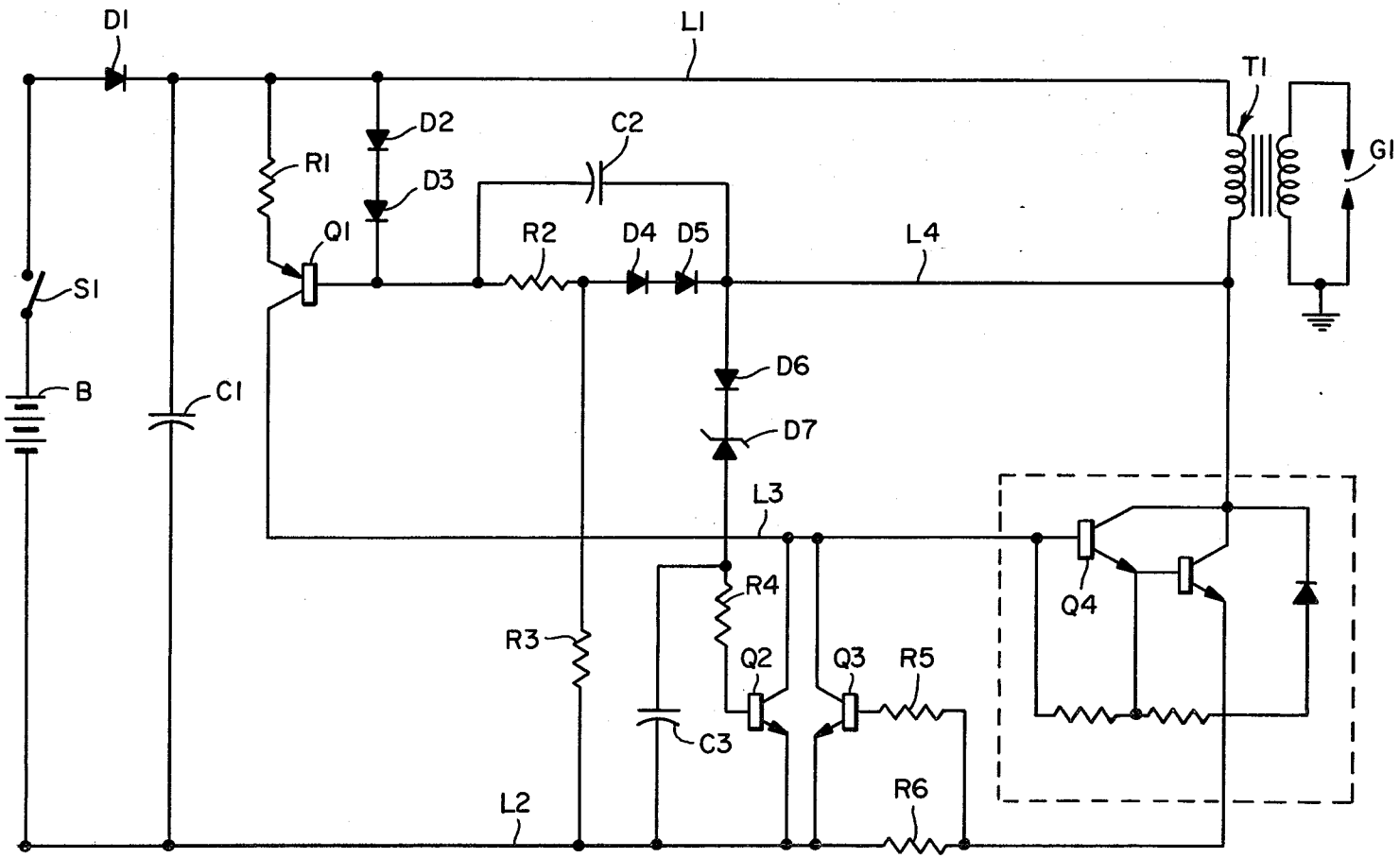
G1
T1
L1
D1
S1
B
C1
R1
Q1
D2
D3
C2
R2
D4
D5
L4
D6
D7
L3
R4
Q2
C3
R3
L2
Q3
R5
R6
Q4

INDUCTIVE SPARK IGNITION FOR COMBUSTION ENGINE

The invention relates to an ignition system especially adapted for gas turbine engines and the like.

BACKGROUND OF THE INVENTION

An ignition system for gas turbine engines is shown and described in U.S. Pat. No. 3,731,143 issued May 1, 1973 and assigned to the same assignee as the present application. The ignition system described therein has a high energy output capability at low input voltage. While the circuit works well, there is a possibility of semiconductor failure under igniter load conditions, such as open circuit, short circuit and flame impingement. Experience has shown that it is difficult to design satisfactory inductive ignition circuits using semiconductors which will operate under igniter plug load conditions mentioned above. Failures occur due to excessive junction temperatures generated during the igniter load variations.

In order to overcome this problem, U.S. Pat. No. 3,835,350, issued Sept. 10, 1974 and assigned to the same assignee as the present application, uses a capacitor in parallel with the spark discharge device connected across the secondary winding of the high voltage transformer so that in case of an open circuit across the spark discharge device the capacitor dissipates most of the energy in the secondary circuit instead of the energy being dissipated in the primary circuit with resultant damage to the switching semiconductor and other components therein. However, the capacitor required for this purpose is expensive to manufacture and substantially increases the cost of the ignition circuit.

SUMMARY OF THE INVENTION

The present invention relates to a high energy inductive spark ignition system which is relatively inexpensive and simple to manufacture and which includes circuit means in the primary circuit to protect the switching semiconductor and other components from failure under igniter plug load conditions. The ignition system includes means for positively turning off the switching semiconductor to start a firing cycle and for insuring that the switching semiconductor remains nonconducting long enough to dissipate the energy in the firing circuit. A transistor pair, such as a Darlington transistor, is used for switching and means are provided for limiting voltage and current in the transistor pair.

The invention contemplates an ignition system having a high voltage transformer connected to an igniter plug, comprising first semiconductor switching means connecting the transformer to a voltage source for controlling current through the transformer for firing the igniter plug, second semiconductor switching means connected to the first switching means for controlling current through the first switching means, first circuit means connected to the second switching means for operating the second switching means to positively turn off the first switching means at the start of an igniter plug firing period, second circuit means connected to the first switching means for sensing a predetermined voltage level across the first switching means to positively maintain the first switching means turned off during igniter plug firing until energy in the firing circuit is dissipated.

DESCRIPTION OF THE DRAWING

The single FIGURE of the drawing shows a schematic diagram of an inductive spark ignition system constructed according to the invention.

DETAILED DESCRIPTION OF THE INVENTION

An ignition system for a gas turbine engine shown in the drawing and constructed according to the invention is powered from a low voltage D.C. source, such as the battery B of an automobile. An ignition switch S1 is connected to the positive terminal of the battery in series with a diode D1 and a capacitor C1 connected to the negative terminal of the battery. A high voltage transformer T1 has one end of its primary winding connected by a lead L1 to diode D1 and its secondary winding connected across an igniter gap G1. The other end of primary winding of transformer T1 is connected to a Darlington transistor pair Q4 connected by a resistor R6 and a ground lead L2 to the negative terminal of battery B. The emitter of a transistor Q1 is connected by a resistor R1 to lead L1 and the collector of transistor Q1 is connected by a lead L3 to the base of the transistor pair Q4 for controlling conduction of the transistor pair.

A pair of diodes D2 and D3 are connected between lead L1 and the base of transistor Q1 for regulating current through transistor Q1 and base-drive current to transistor pair Q4. A circuit including a capacitor C2 in parallel with a series connected resistor R2 and diodes D4 and D5 is connected between the base of transistor Q1 and the primary winding of transformer T1 by a lead L4 to sense the voltage on the primary winding and turn off transistor Q1, which positively turns off transistor pair Q4, at the start of a firing period.

Voltage across transistor pair Q4 is limited by a circuit which includes a diode D6, a Zener diode D7 and a resistor R4 connected in series between lead L4 and the base of a transistor Q2, having its collector connected to lead L3 and its emitter connected to ground lead L2. A capacitor C3 is connected between lead L2 and the junction of resistor R4 and Zener diode D7. Capacitor C3 is charged when the voltage across the collector to emitter of transistor pair Q4 exceeds the threshold voltage of series connected diode D6 and Zener diode D7. Current then flows through resistor R4 and base to emitter of transistor Q2 causing transistor Q2 to conduct and divert base drive current from transistor pair Q4 so that transistor pair Q4 remains nonconducting until the voltage charge on capacitor C3 drops below the base to emitter voltage of transistor Q2.

Current in transistor pair Q4 is limited by a circuit including a transistor Q3 having its collector connected to lead L3 and its emitter connected to ground lead 12. The base of transistor Q3 is connected by a resistor R5 to the junction of the emitter of transistor pair Q4 and resistor R6. When the voltage across resistor R6 provides sufficient base drive current, transistor Q3 turns on and turns off transistor pair Q4 by decreasing the base drive current to transistor pair Q4.

OPERATION

When switch A1 is closed, current flows from the positive terminal of battery B through diode D1 and charges capacitor C1. Current also flows through resistor R1, emitter to base of transistor Q1, resistors R2 and R3 to ground lead L2 and provides base current to turn on transistor Q1. Transistor Q1 provides base current to turn on transistor pair Q4. A small current flows from the battery through diode D1, lead L1, primary winding of transformer T1, collector to emitter of transistor pair Q4, resistor R6 and ground lead L2. When transistor pair Q4 turns "on", increased current flows from the positive terminal of battery B through diode D1, resistor R1, emitter to base of transistor Q1, resistor R2, diodes D4 and D5, collector to emitter of transistor pair Q4, resistor R6 and ground lead L2. Capacitor C2 is charged to the voltage across resistor R2 and diodes D4 and D5.

Current from emitter to collector of transistor Q1 increases and causes increased current flow in the base drive of transistor pair Q4 to support an increase in current flow from collector to emitter of the transistor pair and through the primary winding of transformer T1.

Diodes D2 and D3, resistor R1 and emitter to base of transistor Q1 form a constant current regulator. This arrangement regulates emitter to collector current in transistor Q1 which in turn regulates base drive current and conductivity of transistor pair Q4.

Current through primary winding of transformer T1 increases to a peak current level determined by the inductance resistance ratio characteristics and the gain of transistor pair Q4. When the base current in transistor pair Q4 no longer supports increasing current through collector to emitter of transistor pair Q4 and primary winding of transformer T1 the current decreases and the collector to emitter voltage drop across transistor pair Q4 approaches the supply voltage and the charge on capacitor C2 back biases transistor Q1 so that transistor Q1 and transistor pair Q4 turn off very rapidly. A high voltage of about 100 volts or greater appears across primary winding of transformer T1 because of the high rate of change in current in the primary winding. The voltage across the primary winding of transformer T1 adds to the input voltage and the voltage across the secondary winding of transformer T1 is increased by transformer action to 12KV or higher. The voltage is sufficient to break down the igniter plug and a spark occurs across the gap.

To protect transistor pair Q4 from failure under igniter plug load conditions, diode D6 and Zener diode D7 provide for current flow from the primary winding of transformer T1 when the voltage across transistor pair Q4 exceeds the threshold voltage of diode D6 and Zener diode D7 to charge capacitor C3 and turn on transistor Q2 to maintain transistor pair Q4 nonconducting. When the voltage decreases below the threshold voltage Zener diode D7 no longer conducts and transistor Q2 turns off when the voltage charge on capacitor C3 decreases to the base to emitter voltage of transistor Q2.

At the start of plug firing capacitor C2 turns off transistor Q1 and this in turn turns off transistor pair Q4. Transistor Q2 while conducting maintains transistor pair Q4 nonconducting. This arrangement insures that transistor pair Q4 stays off during plug firing long enough to dissipate the energy from the high voltage transformer T1 to avoid damage to the transistor pair. Transistor Q1 again turns on and turns on transistor Q4 as described above to begin another firing cycle.

The ignition system constructed according to the invention has means to positively turn off transistor pair Q4 at the start of plug firing. This is done by the charge on capacitor C2 turning off transistor Q1 which turns off transistor pair Q4.

Means is also provided to limit the voltage across transistor pair Q4 and positively maintain transistor pair Q4 off during plug firing and long enough to dissipate the energy in the firing circuit. Transistor Q2 turns on when the voltage across transistor pair Q4 exceeds the threshold voltage across diode D6 and Zener diode D7 and maintains transistor pair Q4 non-conducting.

Means are provided to limit the current in transistor pair Q4. When the current in transistor pair Q4 attains a predetermined limit the voltage across resistor R6 is sufficient to provide base drive current to turn on transistor Q3 and turn off transistor pair Q4.

In one embodiment of the invention the components used have the values or were of the types indicated below:

R1 — 12 Ω
R2 — 4300 Ω
R3 — 33000 Ω
R4 — 1200 Ω
R5 — 390 Ω
R6 — 0.16 Ω
C1 — 100 μF
C2 — .02 μF
C3 — .68 μF
D1 — MR 752 Molorola, Inc.
D2, D3, D4, D5, D6 — 1N4004 Texas Instrument Inc.
D7 — IN 5381 Motorola, Inc.
Q1 — TIP 30A Texas Instrument, Inc.
Q2, Q3 — 2 N 706 Motorola, Inc.
Q4 — TIP 160 Texas Inst. Inc.
T1 — 10-397252 — Transformer with 250 Primary Turns 16,500 Secondary turns
Essex International Inc. Kenton, Ohio The high energy inductive spark ignition system is especially adapted for use in gas turbine engines and is relatively inexpensive and simple to manufacture. The switching semiconductor components are protected from failure under igniter plug load conditions. The switching semiconductor is positively turned off at the start of the firing cycle and continues to be turned off longer than is required to dissipate the energy in the firing circuit. Means are also provided for limiting voltage and current in the switching semiconductor.

What is claimed is:

1. An untimed ignition system having a high voltage transformer connected to an igniter plug, comprising first semiconductor switching means having an input and an output, said output connecting the transformer to a voltage source for controlling current through the transformer for firing the igniter plug, second semiconductor switching means having an input and an output, said output connected to the input of the first semiconductor switching means for controlling current through the first semiconductor switching means, first circuit means connected between the output of first semiconductor switching means and the input of the second semiconductor switching means for operating the second switching means to positively turn off the first switching means at the start of an igniter plug firing period and in response to a signal from the output of the first switching means and second circuit means having an input connected to the first switching means for sensing a predetermined voltage level across the first switching means and having an output connected directly to the input of the first switching means to positively maintain the first switching means turned off during igniter plug firing until energy in the firing circuit is dissipated.

2. An ignition system as described in claim 1 comprising third circuit means including at least one diode connected to the input of the second switching means for regulating current through the second switching means.

3. An ignition system as described in claim 1 comprising fourth circuit means connected to the input of the first switching means for sensing current flow through the first switching means to limit current through the first switching means.

4. An untimed ignition system having a high voltage transformer connected to an igniter plug, comprising:

first semiconductor switching means having an input and an output, said output connecting the transformer to a voltage source for controlling current through the transformer for firing the igniter plug;

second semiconductor switching means having an input and an output, said output connected to the input of the first semiconductor switching means for controlling current through the first semiconductor switching means;

first circuit means, including a capacitor connected in parallel with a resistor and a diode, connected between the output of first semiconductor switching means and the input of the second semiconductor switching means for operating the second switching means, said resistor and diode for back biasing the second switching means to rapidly and positively turn off the first switching means at the start of an igniter plug firing period in response to a signal from the output of the first switching means; and second circuit means connected to the first switching means for sensing a predetermined voltage level across the first switching means to positively maintain the first switching means turned off during igniter plug firing until energy in the firing circuit is dissipated.

5. An ignition system as described in claim 4 in which the first switching means is a Darlington transistor.

6. An untimed ignition system having a high voltage transformer connected to an igniter plug, comprising:

first semiconductor switching means having an input and an output, said output connecting the transformer to a voltage source for controlling current through the transformer for firing the igniter plug;

second semiconductor switching means having an input and an output, said output connected to the input of the first semiconductor switching means for controlling current through the first semiconductor switching means;

first circuit means connected between the output of first semiconductor switching means and the input of the second semiconductor switching means for operating the second switching means to positively turn off the first switching means at the start of an igniter plug firing period and in response to a signal from the output of the first switching means;

second circuit means including means connected to the first switching means for sensing a predetermined voltage level across the output of the first switching means to positively maintain the first switching means turned off during igniter plug firing until energy in the firing circuit is dissipated; and third semiconductor switching means connected to the diode means and also to the input of the first switching means, said third switching means adapted to turn off the first switching means when the voltage across the first switching means exceeds the predetermined level.

7. An untimed ignition system having a high voltage transformer connected to an igniter plug, comprising:

first semiconductor switching means having an input and an output, said output connecting the transformer to a voltage source for controlling current through the transformer for firing the igniter plug;

second semiconductor switching means including a transistor having an input and an output, said output connected to the input of the first semiconductor switching means for controlling current through the first semiconductor switching means;

first circuit means connected between the output of first semiconductor switching means and the input of the second semiconductor switching means for operating the second switching means to positively turn off the first switching means at the start of an igniter plug firing period and in response to a signal from the output of the first switching means;

second circuit means connected to the first switching means for sensing a predetermined voltage level across the first switching means to positively maintain the first switching means turned off during igniter plug firing until energy in the firing circuit is dissipated; and third circuit means including diode means connected across the emitter-base circuit of the transistor of the second switching means for regulating the current through the second switching means.

8. An untimed ignition system having a high voltage transformer connected to an igniter plug, comprising:

first semiconductor switching means having an input and an output, said output connecting the transformer to a voltage source for controlling current through the transformer for firing the igniter plug;

second semiconductor switching means having an input and an output, said output connected to the input of the first semiconductor switching means for controlling current through the first semiconductor switching means;

first circuit means connected between the output of first semiconductor switching means and the input of the second semiconductor switching means for operating the second switching means to positively turn off the first switching means at the start of an igniter plug firing period and in response to a signal from the output of the first switching means;

second circuit means connected to the first switching means for sensing a predetermined voltage level across the first switching means to positively maintain the first switching means turned off during igniter plug firing until energy in the firing circuit is dissipated; and additional circuit means connected to the input of the first semiconductor switching means for sensing current flow through the first semiconductor switching means, said additional circuit means including an additional semiconductor switching means controlled by the current sensing means for limiting the current through the first semiconductor switching means.

9. An ignition system as described in claim 8 in which the current sensing means includes a resistor connected in series with the first switching means and the additional switching means is a transistor connected across the base omitter circuit of the first semiconductor switching means.

10. An ignition system as described in claim 9 wherein said first semiconductor switching means includes a Darlington transistor and said second semiconductor switching means includes a transistor.

* * * * *